US011994119B2

(12) United States Patent
Kim et al.

(10) Patent No.: US 11,994,119 B2
(45) Date of Patent: May 28, 2024

(54) COMPRESSOR

(71) Applicant: Hanon Systems, Daejeon (KR)

(72) Inventors: Kwang Jin Kim, Daejeon (KR); Ok Hyun Kim, Daejeon (KR); Seyoung Song, Daejeon (KR); Jun Sig Choi, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 382 days.

(21) Appl. No.: 17/311,398

(22) PCT Filed: Jan. 2, 2020

(86) PCT No.: PCT/KR2020/000026
§ 371 (c)(1),
(2) Date: Jun. 7, 2021

(87) PCT Pub. No.: WO2020/145569
PCT Pub. Date: Jul. 16, 2020

(65) Prior Publication Data

US 2022/0025875 A1 Jan. 27, 2022

(30) Foreign Application Priority Data

Jan. 8, 2019 (KR) ..... 10-2019-0002224

(51) Int. Cl.
*F04B 27/10* (2006.01)
*F04B 1/295* (2020.01)
*F04B 27/18* (2006.01)

(52) U.S. Cl.
CPC ..... *F04B 27/109* (2013.01); *F04B 1/295* (2013.01); *F04B 27/1063* (2013.01); *F04B 2027/189* (2013.01); *F04B 2027/1895* (2013.01)

(58) Field of Classification Search
CPC ..... F04B 1/148; F04B 1/295; F04B 27/1063; F04B 27/1081; F04B 27/109;
(Continued)

(56) References Cited

U.S. PATENT DOCUMENTS 4,588,642 A * 5/1986 Ochiumi ..... B32B 27/08 428/522
5,795,139 A * 8/1998 Ikeda ..... F04B 27/109 62/470
(Continued)

FOREIGN PATENT DOCUMENTS

CN 1136640 A 11/1996
CN 1201502 A 12/1998
(Continued)

*Primary Examiner* — Devon C Kramer
*Assistant Examiner* — Joseph S. Herrmann
(74) *Attorney, Agent, or Firm* — Shumaker, Loop & Kendrick, LLP; James D. Miller

(57) ABSTRACT

A compressor including: a casing; a rotary shaft rotatably mounted in the casing; a compression mechanism configured to compress a refrigerant by operating in conjunction with the rotary shaft; a thrust plate configured to support an end surface of the rotary shaft; a chamber configured to accommodate the thrust plate; and a slit configured to guide oil to the chamber, in which a part of the slit is formed to face a contact portion between the rotary shaft and the thrust plate, such that it is possible to supply the oil between the rotary shaft and the thrust plate, thereby preventing damage to the thrust plate for supporting the rotary shaft. In addition, an inner diameter of the chamber gradually increases, and the chamber extends to an end surface of a cylinder block, such that the cylinder block may be easily extracted from a mold.

10 Claims, 5 Drawing Sheets

(58) Field of Classification Search
CPC ..... F04B 2027/1886; F04B 2027/189; F04B 2027/1895
USPC ..... 184/6.17; 92/154
See application file for complete search history.

(56) References Cited

U.S. PATENT DOCUMENTS

| | | | | |
|---|---|---|---|---|
| 6,206,648 | B1 * | 3/2001 | Kimura | F04B 27/109 184/6.17 |
| 2003/0000378 | A1 * | 1/2003 | Ahn | F16C 27/08 92/71 |
| 2007/0177991 | A1 * | 8/2007 | Inoue | F04B 39/04 417/269 |
| 2009/0145293 | A1 * | 6/2009 | Kawachi | F04B 27/109 417/366 |
| 2009/0220356 | A1 * | 9/2009 | Yamamoto | F04B 27/1804 417/222.1 |
| 2012/0201697 | A1 * | 8/2012 | Ganster | F04B 39/02 417/269 |

FOREIGN PATENT DOCUMENTS

| | | | |
|---|---|---|---|
| CN | 1324985 | A | 12/2001 |
| CN | 101334016 | A | 12/2008 |
| CN | 101451518 | A | 6/2009 |
| CN | 104884800 | A | 9/2015 |
| JP | 2003343440 | A | 12/2003 |
| JP | 2005188508 | A | 7/2005 |
| JP | 2008057336 | A | 3/2008 |
| JP | 2015068187 | A | 4/2015 |
| JP | 2017096128 | A | 6/2017 |
| KR | 20080010111 | A | 1/2008 |
| KR | 20110093200 | A | 8/2011 |
| KR | 101181157 | B1 | 9/2012 |
| WO | 2014103073 | A1 | 7/2014 |

* cited by examiner

COMPRESSOR

CROSS-REFERENCE TO RELATED PATENT APPLICATIONS

This patent application is a United States national phase patent application based on PCT/KR2020/000026 filed on Jan. 2, 2020, which claims the benefit of Korean Patent Application No. 10-2019-0002224 filed on Jan. 8, 2019, the entire contents of both of which are hereby incorporated herein by reference.

TECHNICAL FIELD

The present disclosure relates to a compressor, and more particularly, to a compressor capable of preventing damage to a thrust plate configured to support a rotary shaft for transmitting a rotational force from a driving source to a compression mechanism.

BACKGROUND ART

In general, an air conditioning (A/C) device is installed in a vehicle to cool and heat the interior of the vehicle. The air conditioning device includes a compressor which is a component of a cooling system, and the compressor compresses a low-temperature and low-pressure gaseous refrigerant introduced from an evaporator to make a high-temperature and high-pressure gaseous refrigerant and delivers the refrigerant to a condenser.

The compressors are classified into a reciprocating compressor which compresses a refrigerant using a reciprocating motion of a piston, and a rotary compressor which compresses a refrigerant using a rotational motion.

Depending on methods of transmitting driving power, the reciprocating compressors are classified into a crank compressor which transmits power to a plurality of pistons using a crank, and a swash plate compressor which transmits power to a rotary shaft on which a swash plate is installed. The rotary compressors are classified into a vane rotary compressor which uses a rotating rotary shape and vanes, and a scroll compressor which uses an orbiting scroll and a fixed scroll.

Typically, the compressor includes a compression mechanism configured to compress a refrigerant, and a rotary shaft configured to transmit a rotational force from a driving source to the compression mechanism.

Further, the compressor further includes a rotary shaft support body configured to support the rotary shaft in an axial direction of the rotary shaft.

Specifically, referring to Korean Patent No. 10-1181157, a compressor according to one embodiment in the related art (the embodiment illustrated in FIGS. 1 and 2 of Korean Patent No. 10-1181157) includes a casing, compression mechanisms 160, 170, and 140 provided in the casing and configured to compress a refrigerant, a rotary shaft 150 configured to transmit a rotational force to the compression mechanisms 160, 170, and 140 from a driving source (e.g., an engine) provided outside the casing, and thrust bearings 153a, 154, and 153b configured to support the rotary shaft 150 in an axial direction of the rotary shaft 150.

However, the compressor according to one embodiment in the related art has a problem in that the thrust bearings 153a, 154, and 153b have complicated structures, which causes an increase in costs.

In order to solve the problem of the compressor according to the embodiment in the related art, Korean Patent No. 10-1181157 discloses a compressor according to another embodiment in the related art (the embodiment illustrated in FIGS. 3 and 4 of Korean Patent No. 10-1181157). That is, the compressor according to another embodiment in the related art includes a thrust plate 52 which is substituted for the thrust bearings 153a, 154, and 153b of the compressor according to one embodiment in the related art.

In the compressor according to another embodiment in the related art, a coating layer is provided on a surface of the thrust plate 52, but there is a problem in that the coating layer is detached due to a lack of supply of oil between the thrust plate 52 and a rotary shaft 50, which causes damage to the thrust plate 52.

In addition, in the compressors in the related art disclosed in Korean Patent No. 10-1181157, a chamber, which accommodates the thrust bearings 153a, 154, and 153b or the thrust plate 52, is formed in a cylindrical shape. For this reason, there is a problem in that it is difficult to extract a cylinder block 10 or 110, which defines the chamber, from a mold.

SUMMARY

Accordingly, an object of the present disclosure is to provide a compressor capable of preventing damage to a thrust plate for supporting a rotary shaft.

Further, another object of the present disclosure is to provide a compressor having a cylinder block which has a chamber for accommodating a thrust plate and may be easily extracted from a mold.

In order to achieve the above-mentioned objects, the present disclosure provides a compressor including: a casing; a rotary shaft rotatably mounted in the casing; a compression mechanism configured to compress a refrigerant by operating in conjunction with the rotary shaft; a thrust plate configured to support an end surface of the rotary shaft; a chamber configured to accommodate the thrust plate; and a slit configured to guide oil to the chamber, in which a part of the slit is formed to face a contact portion between the rotary shaft and the thrust plate.

The casing may include: a bore; a suction chamber; a discharge chamber; and a crank chamber, the compression mechanism may include: a swash plate configured to rotate in the crank chamber by operating in conjunction with the rotary shaft; a piston configured to reciprocate in the bore by operating in conjunction with the swash plate, the piston being configured to define a compression chamber together with the bore; and an inclination adjusting mechanism configured to adjust an inclination angle of the swash plate with respect to the rotary shaft, the inclination adjusting mechanism may include: an inflow path configured to guide a fluid in the discharge chamber to the crank chamber; and an outflow path configured to guide the fluid in the crank chamber to the suction chamber, and the slit may be provided to allow the outflow path and the chamber to communicate with each other.

The casing may include: a cylinder block having the chamber; and a rear housing fastened to the cylinder block and having the suction chamber and the discharge chamber, the cylinder block may include an end surface facing the rear housing, and the chamber and the slit may extend to the end surface of the cylinder block from a tip portion of the rotary shaft.

The chamber may include: a first chamber configured to accommodate the thrust plate; a second chamber configured to communicate with the first chamber; and a third chamber configured to communicate with the second chamber and extending to the end surface of the cylinder block.

The slit may be provided to allow the outflow path to communicate with the first chamber, the second chamber, and the third chamber.

An inner diameter of the second chamber may be smaller than an inner diameter of the first chamber.

A stepped surface may be formed between the first chamber and the second chamber, and the stepped surface may be formed to be perpendicular to an inner circumferential surface of the first chamber.

An inner diameter of the third chamber may be larger than the inner diameter of the second chamber.

The third chamber may be formed such that the inner diameter of the third chamber gradually increases toward the rear housing.

The third chamber may be formed such that an increase rate of the inner diameter of the third chamber increases and then decreases toward the rear housing.

An oil recovery hole, which allows the third chamber and the inflow path to communicate with each other, may be formed in the end surface of the cylinder block to recover the oil in the chamber to the crank chamber.

The thrust plate may include a bearing surface configured to support the end surface of the rotary shaft, and at least one oil groove may be formed in the bearing surface.

The oil groove may extend from a centripetal side to a centrifugal side of the rotary shaft.

A coating layer may be formed on the bearing surface.

The coating layer may be made of PTFE.

A compressor according to the present disclosure includes: the casing; the rotary shaft rotatably mounted in the casing; the compression mechanism configured to compress the refrigerant by operating in conjunction with the rotary shaft; the thrust plate configured to support the end surface of the rotary shaft; the chamber configured to accommodate the thrust plate; and the slit configured to guide oil to the chamber, in which a part of the slit is formed to face the contact portion between the rotary shaft and the thrust plate, such that it is possible to supply the oil between the rotary shaft and the thrust plate, thereby preventing damage to the thrust plate for supporting the rotary shaft.

In addition, the inner diameter of the chamber gradually increases, and the chamber extends to the end surface of the cylinder block, such that the cylinder block may be easily extracted from the mold.

DETAILED DESCRIPTION OF AN EMBODIMENT

Hereinafter, a compressor according to the present disclosure will be described in detail with reference to the accompanying drawings.

Figure 1:
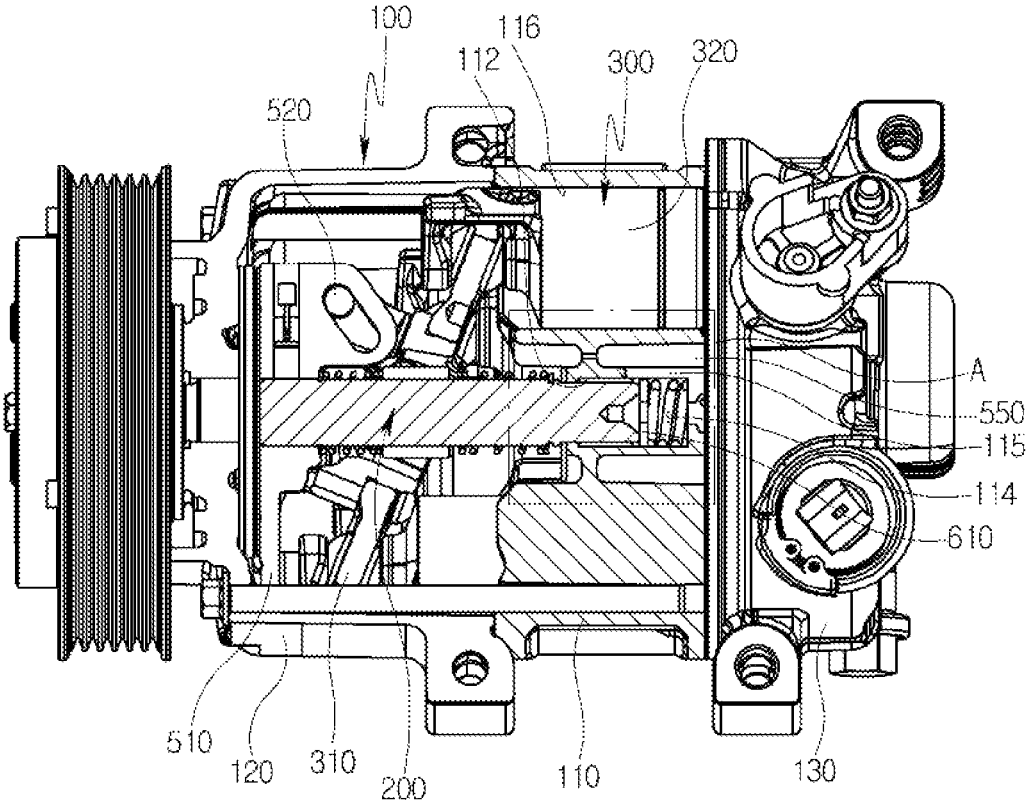
FIG. 1 is a cross-sectional view illustrating a compressor according to an embodiment of the present disclosure.
Figure 2:
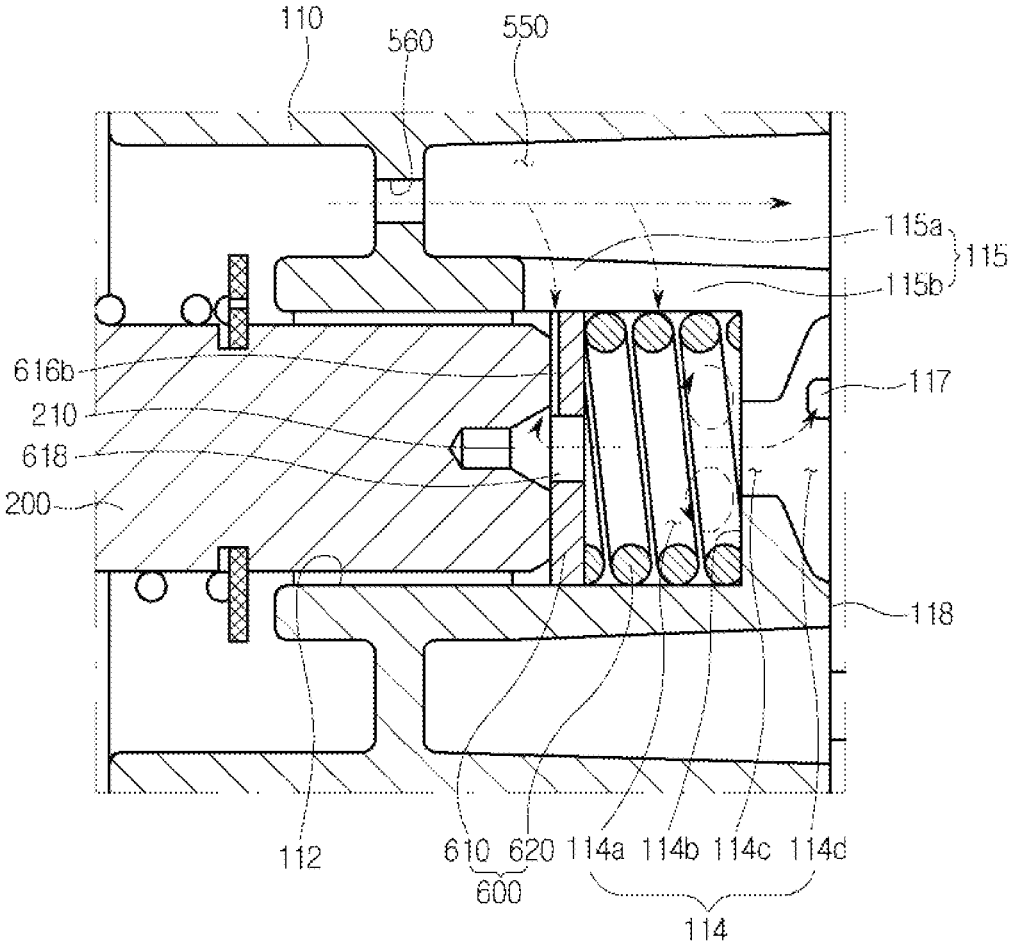
FIG. 2 is an enlarged view of part A in FIG. 1.
Figure 3:
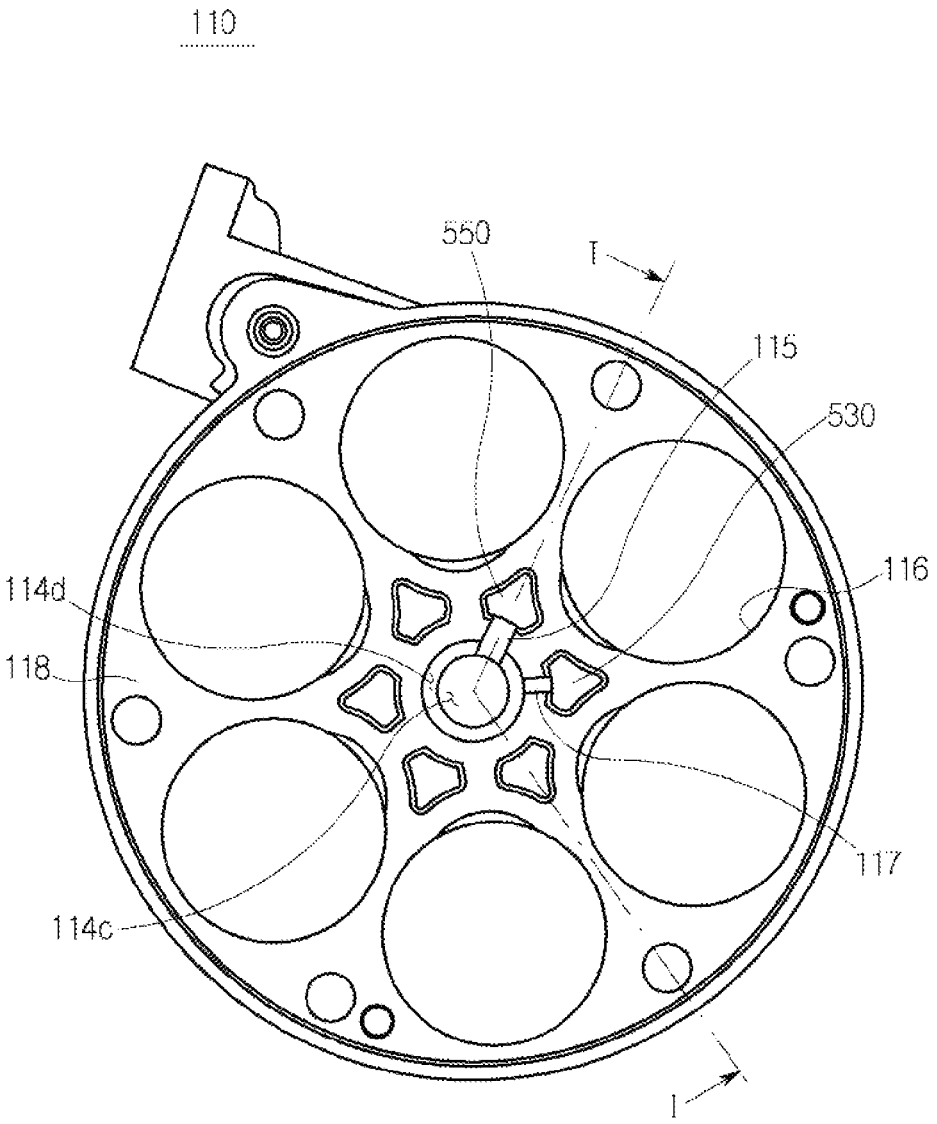
FIG. 3 is a front view illustrating an end surface of a cylinder block of the compressor illustrated in FIG. 1.
Figure 4:
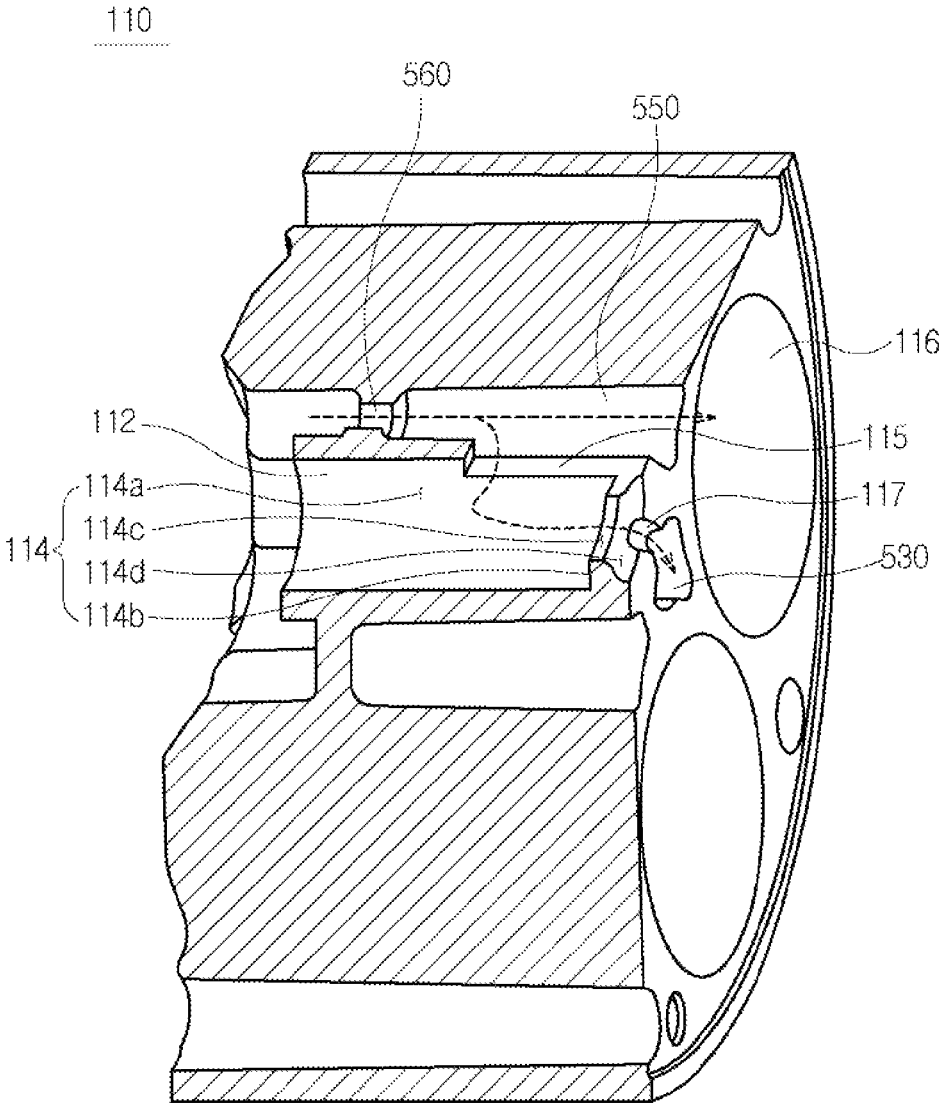
FIG. 4 is a perspective view taken along line I-I in FIG. 3.
Figure 5:
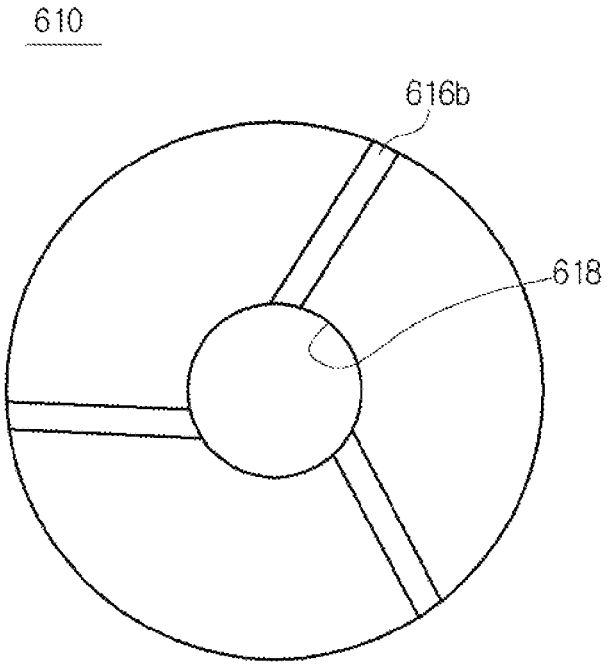
FIG. 5 is a front view illustrating a thrust plate of the compressor illustrated in FIG. 1.

FIG. 1 is a cross-sectional view illustrating a compressor according to an embodiment of the present disclosure, FIG. 2 is an enlarged view of part A in FIG. 1, FIG. 3 is a front view illustrating an end surface of a cylinder block of the compressor illustrated in FIG. 1, FIG. 4 is a perspective view taken along line I-I in FIG. 3, and FIG. 5 is a front view illustrating a thrust plate of the compressor illustrated in FIG. 1.

Referring to the attached FIGS. 1 to 5, the compressor according to the embodiment of the present disclosure may include a casing 100, a rotary shaft 200 rotatably mounted in the casing 100, and a compression mechanism 300 configured to compress a refrigerant by being supplied with a rotational force from a driving source (e.g., an engine) (not illustrated) through the rotary shaft 200.

The casing 100 may include a cylinder block 110 configured to accommodate the compression mechanism 300, a front housing 120 coupled to a front side of the cylinder block 110, and a rear housing 130 coupled to a rear side of the cylinder block 110.

A shaft receiving hole 112 into which the rotary shaft 200 is inserted is formed at a center of the cylinder block 110, and a chamber 114 is provided in the cylinder block 110 to communicate with the shaft receiving hole 112 and accommodate a rotary shaft support body 600 to be described below. Bores 116 are formed in an outer circumferential portion of the cylinder block 110, pistons 320 to be described below are inserted into the bores 116, and the bores 116, together with the pistons 320, define compression chambers. An inflow path 530 to be described below and an outflow path 550 to be described below may be provided between the bore 116 and the shaft receiving hole 112 and between the bore 116 and the chamber 114, respectively.

In this case, the chamber 114 may include a first chamber 114*a* configured to accommodate a thrust plate 610 to be described below and an elastic member 620 to be described below, a second chamber 114*c* configured to communicate with the first chamber 114*a* at a side opposite to the shaft receiving hole 112 based on the first chamber 114*a*, and a third chamber 114*d* configured to communicate with the second chamber 114*c* at a side opposite to the first chamber 114*a* based on the second chamber 114*c*.

An inner diameter of the first chamber 114*a* may be defined at the same level as an inner diameter of the shaft receiving hole 112 so that the thrust plate 610 to be described below and the elastic member 620 to be described below may be inserted into the first chamber 114*a* through the shaft receiving hole 112.

An inner diameter of the second chamber 114*c* may be smaller than the inner diameter of the first chamber 114*a* so that the second chamber 114*c* supports the elastic member 620 to be described below and oil introduced into the first chamber 114*a* is stored in the first chamber 114*a*, as described below.

Further, a stepped surface 114*b* is formed between the first chamber 114*a* and the second chamber 114*c* by a difference between the inner diameter of the first chamber 114*a* and the inner diameter of the second chamber 114*c*. The stepped surface 114*b* may be formed to be perpendicular to an inner circumferential surface of the first chamber 114*a* so that the oil is more effectively stored in the first chamber 114*a*. That is, as the oil in the first chamber 114*a* collides with the stepped surface 114*b*, a swirl flow is generated, and a bottleneck section is generated between the first chamber 114*a* and the second chamber 114*c* by the swirl flow. The stepped surface 114*b* may be formed to be perpendicular to the inner circumferential surface of the first chamber 114*a* so that an inner diameter of the bottleneck section is smaller than the inner diameter of the second chamber 114*c*.

The third chamber 114*d* extends to an end surface 118 of the cylinder block 110, which faces the rear housing 130, and an inner diameter of the third chamber 114*d* may be larger than the inner diameter of the second chamber 114*c* so that a mold (not illustrated) inserted into the third chamber 114*d* is easily extracted when the cylinder block 110 is extracted from the mold (not illustrated).

Further, the third chamber 114*d* may be formed in a conical shape such that the inner diameter of the third chamber 114*d* gradually increases toward the rear housing 130 so that the mold (not illustrated) is more easily extracted from the third chamber 114*d*.

Further, the third chamber 114*d* may be formed such that an increase rate of the inner diameter of the third chamber 114*d* increases and then decreases toward the rear housing 130 so that the mold (not illustrated) is still more easily extracted from the third chamber 114*d*.

Meanwhile, the cylinder block 110 may be formed with a slit 115 configured to allow the chamber 114 and the outflow path 550 to be described below to communicate with each other, and an oil recovery hole 117 configured to allow the chamber 114 and the inflow path 530 to be described below to communicate with each other.

The slit 115 is formed to penetrate a wall portion between the chamber 114 and the outflow path 550 to be described below and may extend to the end surface 118 of the cylinder block 110 from a tip portion of the rotary shaft 200 so as to allow the outflow path 550 to be described below to communicate with the first chamber 114*a*, the second chamber 114*c*, and the third chamber 114*d*. In this case, a part of the slit 115 may be formed to face a contact portion between the rotary shaft 200 and the thrust plate 610 to be described below.

The oil recovery hole 117 is formed to penetrate a wall portion between the chamber 114 and the inflow path 530 to be described below and may be recessed in the end surface 118 of the cylinder block 110 so as to allow the third chamber 114*d* and the inflow path 530 to be described below to communicate with each other.

The front housing 120 may be fastened to the cylinder block 110 at a side opposite to the rear housing 130 based on the cylinder block 110.

In this case, the cylinder block 110 and the front housing 120 are fastened to each other, such that a crank chamber S4 may be defined between the cylinder block 110 and the front housing 120.

A swash plate 310 to be described below may be accommodated in the crank chamber S4.

The rear housing 130 may be fastened to the cylinder block 110 at a side opposite to the front housing 120 based on the cylinder block 110.

Further, the rear housing 130 may include a suction chamber configured to accommodate the refrigerant to be introduced into the compression chamber, and a discharge chamber configured to accommodate the refrigerant discharged from the compression chamber.

The suction chamber may communicate with a refrigerant suction tube (not illustrated) that guides the refrigerant, which is to be compressed, into the casing 100.

The discharge chamber may communicate with a refrigerant discharge tube (not illustrated) that guides the compressed refrigerant to the outside of the casing 100.

The rotary shaft 200 extends in one direction. One end of the rotary shaft 200 may be inserted into and rotatably supported by the cylinder block 110 (more accurately, the shaft receiving hole 112), the other end of the rotary shaft 200 may penetrate the front housing 120, protrude to the outside of the casing 100, and be connected to the driving source (not illustrated), and a middle portion of the rotary shaft 200 may be connected to the compression mechanism 300.

The compression mechanism 300 may be provided to suck the refrigerant into the compression chamber from the suction chamber, compress the sucked refrigerant in the compression chamber, and discharge the compressed refrigerant from the compression chamber to the discharge chamber.

Specifically, the compression mechanism 300 may include the swash plate 310 configured to rotate in the crank chamber S4 by operating in conjunction with the rotary shaft 200, and the pistons 320 configured to reciprocate in the bores 116 by operating in conjunction with the swash plate 310.

The swash plate 310 may be formed in a circular plate shape and inclinedly fastened to the rotary shaft 200 in the crank chamber S4.

The piston 320 may include one end inserted into the bore 116, and the other end extending from one end to a side opposite to the bore 116 and connected to the swash plate 310 in the crank chamber S4.

Meanwhile, the compressor according to the present embodiment may further include a valve mechanism configured to allow the suction chamber and the discharge chamber to communicate with the compression chamber or block the suction chamber and the discharge chamber from the compression chamber.

The valve mechanism may include a valve plate interposed between the cylinder block 110 and the rear housing 130, a suction reed interposed between the cylinder block 110 and the valve plate, and a discharge reed interposed between the valve plate and the rear housing 130.

In addition, the compressor according to the present embodiment may further include an inclination adjusting mechanism configured to adjust an inclination angle of the swash plate 310 with respect to the rotary shaft 200.

The inclination adjusting mechanism may include: a rotor 510 configured to rotate together with the rotary shaft 200 and fastened to the rotary shaft 200 so that the swash plate 310 is fastened to the rotary shaft 200 so that the inclination angle of the swash plate 310 may be changed; and a sliding pin 520 configured to connect the swash plate 310 and the rotor 510.

The sliding pin 520 may be provided in the form of a cylindrical pin, the swash plate 310 may have a first insertion hole into which the sliding pin 520 is inserted, and the rotor 510 may have a second insertion hole into which the sliding pin 520 is inserted.

The first insertion hole may be formed in a cylindrical shape so that the sliding pin 520 may rotate in the first insertion hole.

The second insertion hole may extend in one direction so that the sliding pin 520 may move along the second insertion hole.

Further, the inclination adjusting mechanism may include: the inflow path 530 configured to guide the refrigerant in the discharge chamber to the crank chamber S4 so as to adjust the inclination angle of the swash plate 310 by adjusting a pressure in the crank chamber S4; a pressure adjusting valve (not illustrated) configured to adjust the amount of the refrigerant to be introduced into the inflow path 530 from the discharge chamber; the outflow path 550 configured to guide the refrigerant in the crank chamber S4 to the suction chamber; and an orifice hole 560 configured to reduce a pressure of the refrigerant passing through the outflow path 550.

In addition, the compressor according to the present embodiment may further include the rotary shaft support body 600 accommodated in the first chamber 114*a* and configured to support one end of the rotary shaft 200 in the axial direction of the rotary shaft 200.

The rotary shaft support body 600 may include the thrust plate 610 being slidably in contact with an end surface of the rotary shaft 200, and the elastic member 620 configured to press the thrust plate 610 toward the rotary shaft 200.

The thrust plate 610 may be provided in the form of a circular plate having an outer circumferential surface facing the inner circumferential surface of the first chamber 114*a*, a bottom surface facing the stepped surface 114*b*, and an upper surface facing the end surface of the rotary shaft 200.

In this case, the upper surface of the thrust plate 610 is a bearing surface for supporting the end surface of the rotary shaft 200. For example, a PTFE coating layer may be formed on the upper surface of the thrust plate 610 in order to reduce friction with the rotary shaft 200.

Further, a recessed oil groove 616*b* may be formed in the upper surface of the thrust plate 610 in order to supply the oil between the upper surface of the thrust plate 610 and the end surface of the rotary shaft 200, thereby reducing friction between the upper surface of the thrust plate 610 and the end surface of the rotary shaft 200.

The oil groove 616*b* may be formed such that a depth of the oil groove 616*b* is 20% or less of a thickness of the thrust plate 610 in order to prevent the thrust plate 610 from being deformed by the oil groove 616*b*.

Further, one or more oil grooves 616*b* may be provided so that the oil is uniformly distributed between the end surface of the rotary shaft 200 and the upper surface of the thrust plate 610 when the rotary shaft 200 rotates. The one or more oil grooves 616*b* may be disposed in a rotation direction of the rotary shaft 200, and each of the oil grooves 616*b* may be radially formed by extending from a centripetal side of the rotary shaft 200 to a centrifugal side of the rotary shaft 200.

Further, the oil groove 616*b* may be formed to be supplied with the oil from the centripetal side of the rotary shaft 200 by a centrifugal force when the rotary shaft 200 rotates.

Specifically, an oil pocket 210, which is recessed from the end surface of the rotary shaft 200, is formed in the end surface of the rotary shaft 200, and a communication hole 618, which penetrates the thrust plate 610 and communicates with the oil pocket 210, is formed in the thrust plate 610 so as to guide the oil in the first chamber 114*a* to the oil pocket 210. The oil pocket 210 and the communication hole 618 may be provided at the centripetal side of the rotary shaft 200, and the oil groove 616*b* may communicate with the oil pocket 210.

In this case, the oil pocket 210 and the communication hole 618 may be formed such that an inner diameter of the communication hole 618 is smaller than an inner diameter of the oil pocket 210 in order to prevent the oil in the oil pocket 210 from being discharged into the first chamber 114*a* through the communication hole 618, thereby increasing the amount of the oil stored in the oil pocket 210.

Hereinafter, an operational effect of the swash plate compressor according to the present embodiment.

That is, when the power is transmitted to the rotary shaft 200 from the driving source (not illustrated), the rotary shaft 200 and the swash plate 310 may rotate together.

Further, the piston 320 may reciprocate in the bore 116 while converting a rotational motion of the swash plate 310 into a rectilinear motion.

Further, when the piston 320 moves from a top dead center to a bottom dead center, the compression chamber communicates with the suction chamber and is blocked from the discharge chamber by the valve mechanism, such that the refrigerant in the suction chamber may be introduced into the compression chamber.

Further, when the piston 320 moves from the bottom dead center to the top dead center, the compression chamber is blocked from the suction chamber and the discharge chamber by the valve mechanism, such that the refrigerant in the compression chamber may be compressed.

Further, when the piston 320 reaches the top dead center, the compression chamber is blocked from the suction chamber by the valve mechanism and communicates with the discharge chamber, such that the refrigerant compressed in the compression chamber may be discharged to the discharge chamber.

Further, in the compressor according to the present embodiment, depending on the amount of the refrigerant required to be discharged, the amount of the refrigerant to be introduced into the inflow path 530 from the discharge chamber is adjusted by the pressure adjusting valve (not illustrated), such that the pressure in the crank chamber S4 may be adjusted, and the pressure in the crank chamber S4 applied to the piston 320 is adjusted, such that the stroke of the piston 320 may be adjusted, the inclination angle of the swash plate 310 may be adjusted, and the amount of the refrigerant to be discharged may be adjusted.

That is, when it is necessary to decrease the amount of the refrigerant to be discharged, the amount of the refrigerant to be introduced into the inflow path 530 from the discharge chamber is increased by the pressure adjusting valve (not illustrated), and the amount of the refrigerant introduced into the crank chamber S4 through the inflow path 530 is increased, such that the pressure in the crank chamber S4 may be increased. Therefore, the pressure in the crank chamber S4 applied to the piston 320 is increased, such that the stroke of the piston 320 may be decreased, the inclination angle of the swash plate 310 may be decreased, and the amount of the refrigerant to be discharged may be decreased.

In contrast, when it is necessary to increase the amount of the refrigerant to be discharged, the amount of the refrigerant to be introduced into the inflow path 530 from the discharge chamber is decreased by the pressure adjusting valve (not illustrated), and the amount of the refrigerant introduced into the crank chamber S4 through the inflow path 530 is decreased, such that the pressure of the crank chamber S4 may be decreased. Therefore, the pressure in the crank chamber S4 applied to the piston 320 is decreased, such that the stroke of the piston 320 may be increased, the inclination angle of the swash plate 310 may be increased, and the amount of the refrigerant to be discharged may be increased.

In this case, in order to decrease the pressure in the crank chamber S4, the amount of the refrigerant to be introduced into the inflow path 530 from the discharge chamber needs to be decreased, and the refrigerant in the crank chamber S4 needs to be discharged to the outside of the crank chamber S4. To this end, the outflow path 550 is provided to guide the refrigerant in the crank chamber S4 to the suction chamber, and the orifice hole 560 is provided to reduce the pressure of the refrigerant passing through the outflow path 550 in order to prevent an increase in pressure in the suction chamber.

Meanwhile, during the process of operating the compressor, the rotary shaft 200 is supported by the rotary shaft support body 600. Since the rotary shaft support body 600 includes the thrust plate 610, the ability of supporting a load may be improved, the structure of the rotary shaft support body 600 may be simplified, and the costs required to provide the rotary shaft support body 600 may be reduced.

Further, since the thrust plate 610 includes the coating layer, the friction between the rotary shaft 200 and the thrust plate 610 may be reduced.

Further, since the coating layer is made of PTFE, lubrication performance and wear resistance of the coating layer may be improved.

Further, the oil groove 616*b* is formed in the thrust plate 610, and the oil is supplied to the oil groove 616*b* through the slit 115, the chamber 114, the communication hole 618, and the oil pocket 210, such that the oil may be supplied between the rotary shaft 200 and the thrust plate 610. Therefore, the friction between the rotary shaft 200 and the thrust plate 610 may be further reduced, and the damage to the thrust plate 610, such as the detachment of the coating layer, may be prevented.

Specifically, the inside of the casing 100 is filled with the oil for lubricating various types of sliding parts, and the oil is contained in the refrigerant and may move in the compressor together with the refrigerant. That is, the oil in the suction chamber may be used to lubricate various types of sliding parts while circulating, together with the refrigerant, into the suction chamber via the compression chamber, the discharge chamber, the inflow path 530, the crank chamber S4, and the outflow path 550.

In this case, a part of the oil (more accurately, the refrigerant containing the oil) moving from the crank chamber S4 to the suction chamber through the outflow path 550 is introduced into the chamber 114 through the slit 115. The oil introduced into the chamber 114 may be supplied to the oil groove 616*b* to lubricate the contact surfaces between the end surface of the rotary shaft 200 and the thrust plate 610 and then returned to the crank chamber S4 through the oil recovery hole 117 and the inflow path 530.

More specifically, when a portion of the slit 115, which faces the contact portion between the tip portion of the rotary shaft 200 and the thrust plate 610, is referred to as a slit first portion 115*a* and a portion of the slit 115, which faces the elastic member 620, is referred to as a slit second portion 115*b*, the oil introduced into the first chamber 114*a* through the slit first portion 115*a* may be supplied to the oil groove 616*b* from the centrifugal side of the rotary shaft 200, and the oil introduced into the first chamber 114*a* through the slit second portion 115*b* may be supplied to the oil groove 616*b* from the centripetal side of the rotary shaft 200 through the communication hole 618 and the oil pocket 210. The oil supplied to the oil groove 616*b* may be used to lubricate the contact surfaces between the end surface of the rotary shaft 200 and the thrust plate 610. The oil, which is used to lubricate the contact surfaces between the end surface of the rotary shaft 200 and the thrust plate 610, may be returned to the crank chamber S4 through the first chamber 114*a*, the second chamber 114*c*, the third chamber 114*d*, the oil recovery hole 117, and the inflow path 530.

In this case, in the compressor according to the present embodiment, the slit 115 is formed to face the contact portion between the rotary shaft 200 and the thrust plate 610, and as a result, the oil may be smoothly and sufficiently supplied to the oil groove 616*b*. That is, unlike the present embodiment, the slit 115 may include only the slit second portion 115*b* (the slit 115 may not face the contact portion between the rotary shaft 200 and the thrust plate 610), such that the oil may be supplied to the oil groove 616*b* only from the centripetal side of the rotary shaft 200. However, in the case in which the slit 115 includes not only the slit second portion 115*b*, but also the slit first portion 115*a*, like the present embodiment, the oil may be supplied to the oil groove 616*b* not only from the centripetal side of the rotary shaft 200, but also from the centrifugal side of the rotary shaft 200, and as a result, the oil may be smoothly and sufficiently supplied to the oil groove 616*b*.

Further, since the inner diameter of the second chamber 114*c* is smaller than the inner diameter of the first chamber 114*a*, the oil in the first chamber 114*a* is inhibited from flowing to the second chamber 114*c*, and as a result, the amount of the oil stored in the first chamber 114*a* may be increased. Therefore, the oil may be smoothly and sufficiently supplied to the oil groove 616*b*.

Further, the stepped surface 114*b*, which is formed by the difference between the inner diameter of the first chamber 114*a* and the inner diameter of the second chamber 114*c*, is formed to be perpendicular to the inner circumferential surface of the first chamber 114*a*, such that a swirl flow may be created. Therefore, since the oil in the first chamber 114*a* is further inhibited from flowing to the second chamber 114*c*, the amount of the oil stored in the first chamber 114*a* may be further increased, and the oil may be smoothly and sufficiently supplied to the oil groove 616*b*.

Further, a part of the oil in the crank chamber S4 circulates into the crank chamber S4 via the outflow path 550, the suction chamber, the compression chamber, the discharge chamber, and the inflow path 530, and the other part of the oil in the crank chamber S4 circulates into the crank chamber S4 via the outflow path 550, the slot, the chamber 114, the oil recovery hole 117, and the inflow path 530, such that comparatively clean oil may be consistently supplied to the oil groove 616*b*. Therefore, it is possible to inhibit foreign substances contained in the oil from increasing friction between the end surface of the rotary shaft 200 and the thrust plate 610 and damaging the end surface of the rotary shaft 200 and the thrust plate 610.

Further, since the slit 115 extends to the end surface 118 of the cylinder block 110 from the tip portion of the rotary shaft 200, the slit 115 may not only allow the first chamber 114*a* to communicate with the outflow path 550, but also allow the second chamber 114*c* and the third chamber 114*d* to communicate with the outflow path 550. Therefore, the oil may more smoothly circulates.

Further, since the inner diameter of the third chamber 114*d*, which is opened toward the end surface 118 of the cylinder block 110, is larger than the inner diameter of the second chamber 114*c*, the cylinder block 110 may be easily extracted from the mold (not illustrated).

Further, since the inner diameter of the third chamber 114*d* gradually increases toward the rear housing 130, the cylinder block 110 may be more easily extracted from the mold (not illustrated).

Further, since the increase rate of the inner diameter of the third chamber 114*d* increases and then decreases toward the rear housing 130, the cylinder block 110 may be still more easily extracted from the mold (not illustrated).

Meanwhile, in the present embodiment, the slit 115 communicates with the second chamber 114*c* and the third chamber 114*d* as well as the first chamber 114*a* so that the oil circulates more smoothly. However, the present disclosure is not limited thereto. Although not illustrated separately, the slit 115 may communicate with only the first chamber 114*a*.

In addition, in the present embodiment, the compression mechanism 300 has the so-called variable capacity swash plate 310, and the inflow path 530 and the outflow path 550 are formed, such that the slit 115 communicates with the outflow path 550. However, the present disclosure is not limited thereto. Although not illustrated separately, the compression mechanism 300 may be configured as a so-called scroll type, such that in a case in which the inflow path 530 and the outflow path 550 are not provided, the slit 115 may communicate with other flow paths (e.g., an oil recovery flow path for returning the oil in the discharge chamber to the suction chamber).

The invention claimed is:

1. A compressor comprising:

a casing;

a rotary shaft rotatably mounted in the casing;

a compression mechanism configured to compress a refrigerant by operating in conjunction with the rotary shaft;

a thrust plate configured to support an end surface of the rotary shaft;

a chamber configured to accommodate the thrust plate; and a slit configured to guide oil to the chamber, wherein a part of the slit is formed to face a contact portion between the rotary shaft and the thrust plate, wherein the casing further comprises a bore, a suction chamber, a discharge chamber and a crank chamber, wherein the compression mechanism further comprises a swash plate configured to rotate in the crank chamber by operating in conjunction with the rotary shaft, a piston configured to reciprocate in the bore by operating in conjunction with the swash plate, the piston configured to define a compression chamber together with the bore, and an inclination adjusting mechanism configured to adjust an inclination angle of the swash plate with respect to the rotary shaft, wherein the inclination adjusting mechanism further comprises an inflow path configured to guide a fluid in the discharge chamber to the crank chamber, and an outflow path configured to guide the fluid in the crank chamber to the suction chamber, and wherein the slit is provided to allow the outflow path and the chamber to communicate with each other, wherein the casing further comprises a cylinder block having the chamber, and a rear housing fastened to the cylinder block and having the suction chamber and the discharge chamber, wherein the cylinder block further comprises an end surface facing the rear housing, and wherein the chamber and the slit extend to the end surface of the cylinder block from a tip portion of the rotary shaft, wherein the chamber further comprises a first chamber configured to accommodate the thrust plate, a second chamber configured to communicate with the first chamber, and a third chamber configured to communicate with the second chamber and extending to the end surface of the cylinder block, wherein the slit is provided to allow the outflow path to communicate with the first chamber, the second chamber, and the third chamber, and wherein an oil recovery hole, which allows the third chamber and the inflow path to communicate with each other, is formed in the end surface of the cylinder block to recover the oil in the chamber to the crank chamber.

2. The compressor of claim 1, wherein an inner diameter of the second chamber is smaller than an inner diameter of the first chamber.

3. The compressor of claim 2, wherein a stepped surface is formed between the first chamber and the second chamber, and the stepped surface is formed to be perpendicular to an inner circumferential surface of the first chamber.

4. The compressor of claim 2, wherein an inner diameter of the third chamber is larger than the inner diameter of the second chamber.

5. The compressor of claim 4, wherein the third chamber is formed such that the inner diameter of the third chamber gradually increases toward the rear housing.

6. The compressor of claim 5, wherein the third chamber is formed such that an increase rate of the inner diameter of the third chamber increases and then decreases toward the rear housing.

7. The compressor of claim 1, wherein the thrust plate further comprises a bearing surface configured to support the end surface of the rotary shaft, and at least one oil groove is formed in the bearing surface.

8. The compressor of claim 7, wherein the at least one oil groove extends from a centripetal side to a centrifugal side of the rotary shaft.

9. The compressor of claim 7, wherein a coating layer is formed on the bearing surface.

10. The compressor of claim 9, wherein the coating layer is made of PTFE.

* * * * *